US006361379B1

(12) United States Patent
Ito et al.

(10) Patent No.: US 6,361,379 B1
(45) Date of Patent: Mar. 26, 2002

(54) ELECTRICAL CONNECTOR

(75) Inventors: Naotoshi Ito, Tokyo; Shigetoshi Yamaguchi, Sagamihara-shim, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/699,658

(22) Filed: Oct. 30, 2000

(30) Foreign Application Priority Data

Nov. 30, 1999 (JP) ..... 11-338964

(51) Int. Cl.[7] ..... H01R 13/514
(52) U.S. Cl. ..... 439/752; 439/692
(58) Field of Search ..... 439/595, 752, 439/682, 690, 692, 189, 507, 723, 724

(56) References Cited

U.S. PATENT DOCUMENTS 4,274,700 A * 6/1981 Keglewitsch et al.

5,295,871 A * 3/1994 Lapraik et al. ..... 439/746

* cited by examiner

*Primary Examiner*—Khiem Nguyen
(74) *Attorney, Agent, or Firm*—Stephen Z. Weiss

(57) ABSTRACT

An electrical connector includes an insulating housing defining a longitudinal axis with two rows of terminal-receiving passages generally on opposite sides of the axis. The passages are alternatingly staggered along the axis, with adjacent sides of the passages in the two rows thereof overlapping along the axis. A plurality of conductive terminals are received in the passages. Each terminal includes a relatively wide body portion with a relatively narrow contact portion projecting from one side of the body portion. The terminals are disposed in the passages in alternating orientations longitudinally of the axis, whereby the contact portions of the terminals are disposed in the overlapping sides of the passages to define a single row of contact portions longitudinally of the axis.

10 Claims, 8 Drawing Sheets

ELECTRICAL CONNECTOR

FIELD OF THE INVENTION

This invention generally relates to the art of electrical connectors and, particularly, to an electrical connector having closely spaced terminals while still providing sizable partitions or walls between the terminals.

BACKGROUND OF THE INVENTION

Generally, an electrical connector includes some form of dielectric or insulating housing defining a plurality of cavities or passages for receiving a plurality of conductive terminals usually fabricated of metal material. The terminals are terminated to various electrical components, such as discrete electrical wires, circuit boards or the like. The terminals have contact portions for engaging the terminals of a complementary mating connector.

With electrical connectors of the character described, it is necessary to separate the terminal-receiving passages in the connector housing by partitions or interior walls which are thick enough to provide good mechanical strength for the connector housing as well as adequate electrical insulation between the terminals. Unfortunately, the interior walls may significantly increase the size of a connector as the number of terminals mounted in the connector increase in number.

For instance, the terminals of the connector may be mounted in one or more rows extending longitudinally of an electrical connector housing. Each terminal in a row is separated by an interior wall. Therefore, the length of the connector is in direct proportion to the number of terminals in a row. It may be proposed to divide a row of terminals into two rows in order to reduce the length of the housing. Unfortunately, this often requires the housing to be wider than is acceptable for a given application. The present invention is directed to solving these problems or this dilemma by providing an electrical connector with closely spaced terminals longitudinally of the connector housing, while maintaining sizable interior walls between the terminals and without excessively increasing the width of the connector housing.

SUMMARY OF THE INVENTION

An object, therefore, of the invention is to provide a new and improved electrical connector of the character described.

In the exemplary embodiment of the invention, the connector includes an insulating housing defining a longitudinal axis with two rows of terminal-receiving passages generally on opposite sides of the axis. The passages are alternatingly staggered on opposite sides of the axis, with adjacent sides of the passages in the two rows thereof overlapping along the axis. A plurality of conductive terminals are received in the passages. Each terminal includes a relatively wide body portion with a relatively narrow contact portion projecting from one side of the body portion. The terminals are disposed in the passages in alternating orientation longitudinally of the axis, whereby the contact portions of the terminals are disposed in the overlapping sides of the passages to define a single row of contact portions longitudinally of the axis.

As disclosed herein, the terminals are stamped and formed of conductive sheet metal material. The contact portion of each terminal projects from one end of the body portion thereof. A terminating portion is disposed at an opposite end of the body portion. In the illustrated embodiment, the terminating portion comprises a crimping section of the terminal for clamping onto an electrical wire. The contact portion may comprise a pin projecting from the one side of the body portion.

According to another aspect of the invention, a terminal retainer is operatively associated between the housing and the terminals to hold the terminals in their respective passages in the housing. The terminal retainer is mountable on the outside of the housing and includes a plurality of fingers extending into the passages in the housing and into retaining engagement with the terminals. Complementary interengaging latch means are provided between the terminal retainer and the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1A:
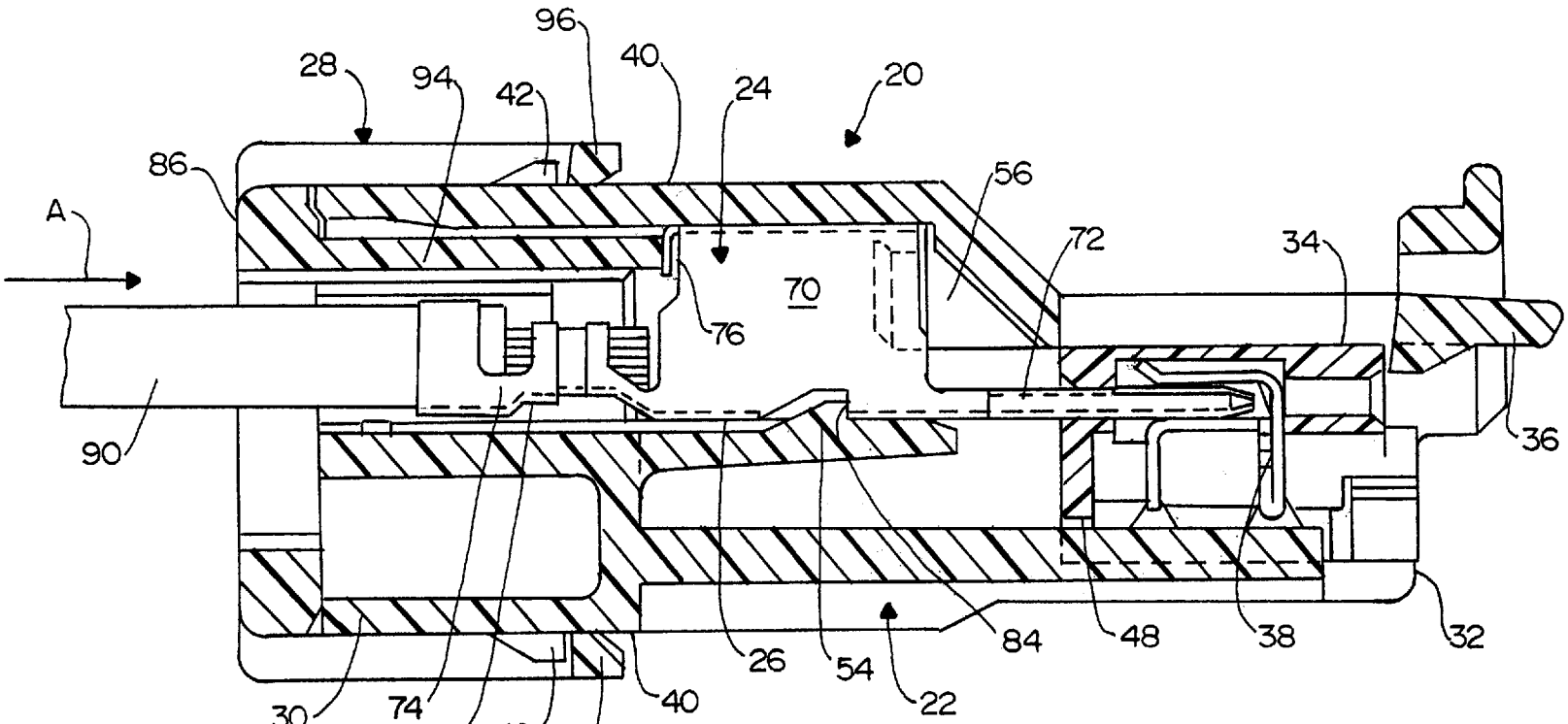
FIGS. 1A and 1B are front-to-rear enlarged sections through an electrical connector according to the invention, showing a pair of adjacent, alternatingly oriented terminals.
Figure 1B:
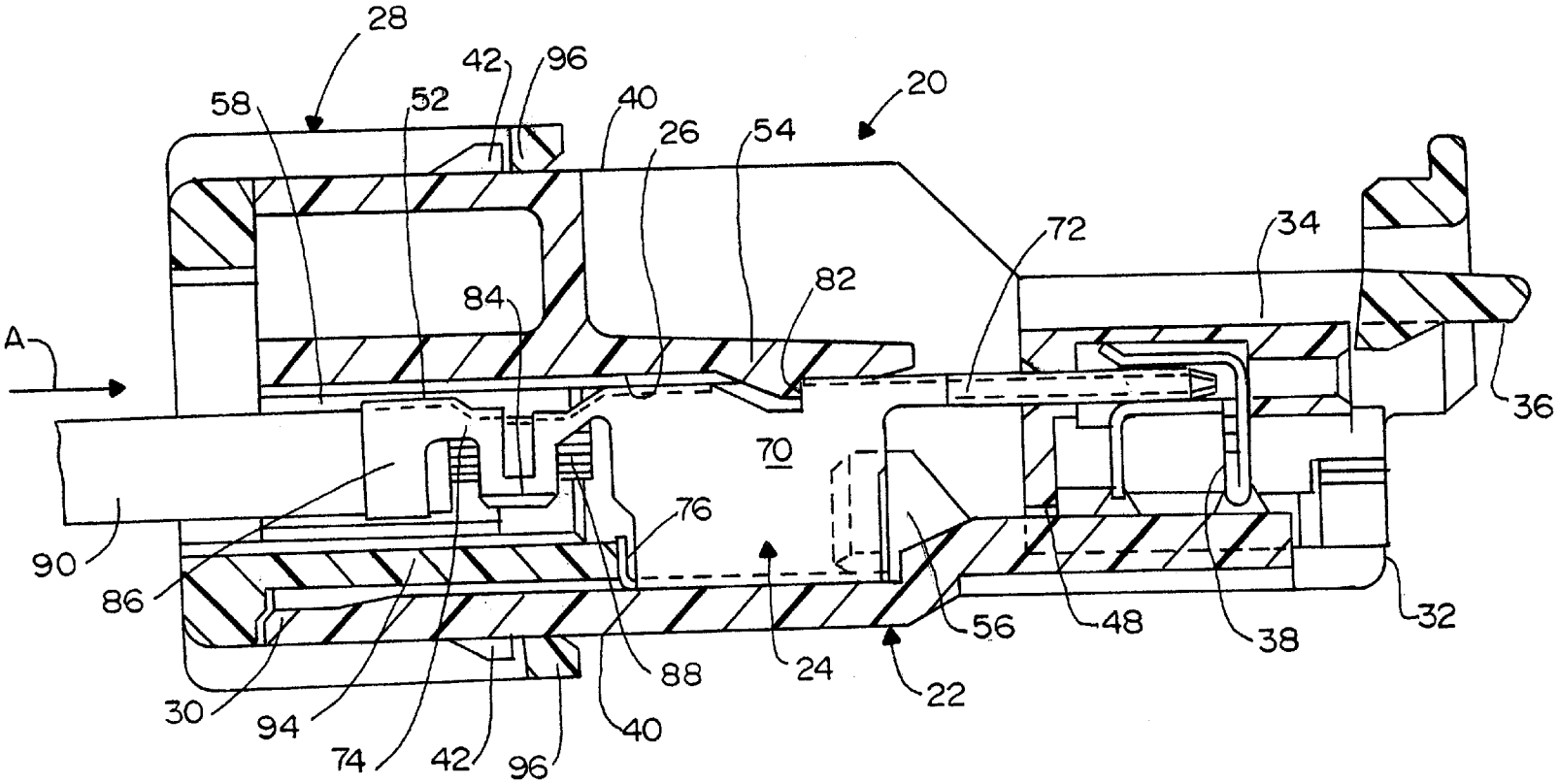
Figure 2:
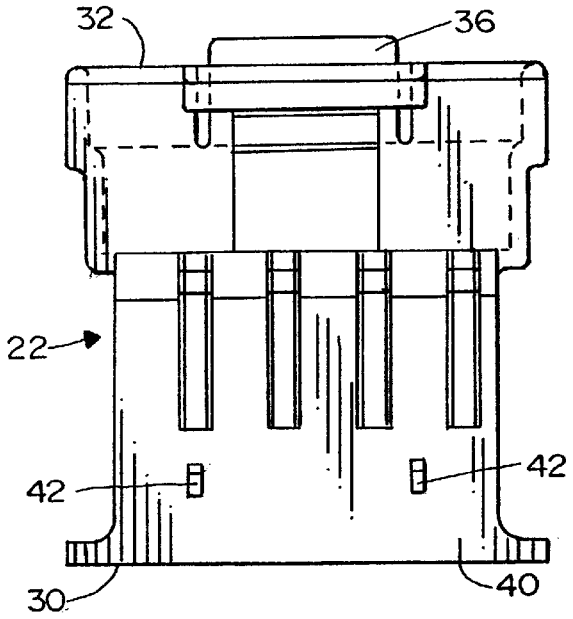
FIG. 2 is a top plan view of the connector housing.

Referring to the drawings in greater detail, and first to FIGS. 1A and 1B, the invention is embodied in an electrical connector, generally designated 20, which includes a dielectric or insulating housing, generally designated 22, mounting a plurality of conductive terminals, generally designated 24. Housing 22 preferably is molded of insulating material such as plastic or the like. Terminals 24 preferably are stamped and formed of conductive sheet metal material. The terminals are mounted within cavities or passages 26 in the housing and are inserted into the housing in the direction of arrows "A" (FIGS. 1A and 1B). As will be described in greater detail hereinafter, a terminal retainer 28 is mounted on the rear of the housing, also in the direction of arrows "A", to hold terminals 24 within passages 26 in connector housing 22.

Still referring to FIGS. 1A and 1B, connector housing 22 has a rear end 30 and a front end 32. Terminal retainer 28 is mounted at the rear end of the housing. Although not part of the invention, a complementary mating connector 34 is engaged with the housing at front end 32 thereof. An integral, pivotable latch 36 holds the mating connector at the front end of the housing. The mating connector includes a plurality of terminals 38 for engaging contact pin portions (described hereinafter) of terminals 24. Referring to FIGS. 2–7 in conjunction with FIGS. 1A and 1B, connector housing 22 further includes top and bottom surfaces 40 having latch bosses 42 projecting therefrom for latchingly engaging terminal retainer 28, as described hereinafter.

Figure 3:
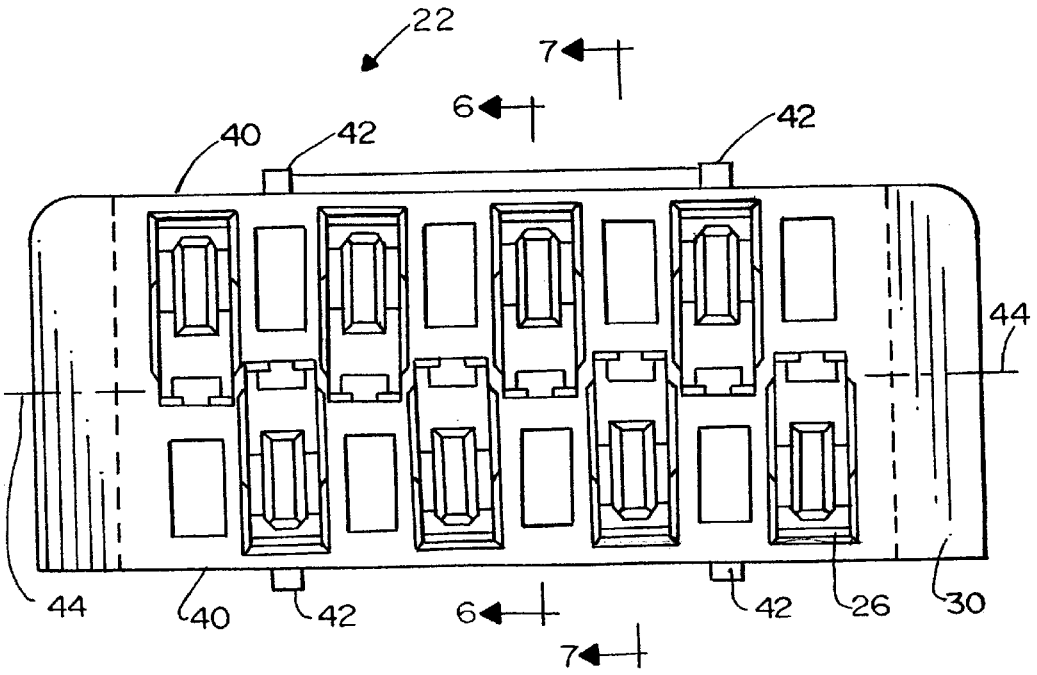
FIG. 3 is a rear end elevational view of the housing.
Figure 4:
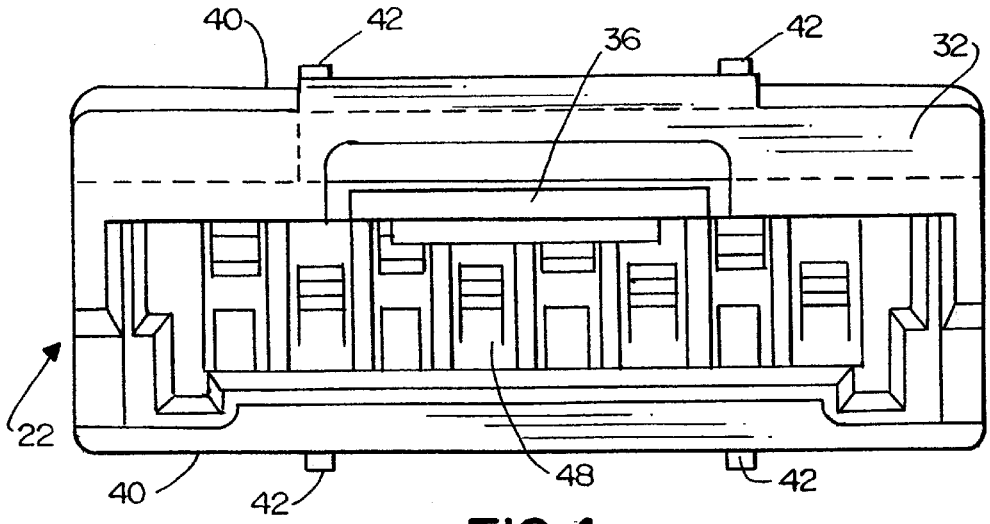
FIG. 4 is a front end elevational view of the housing.
Figure 5:
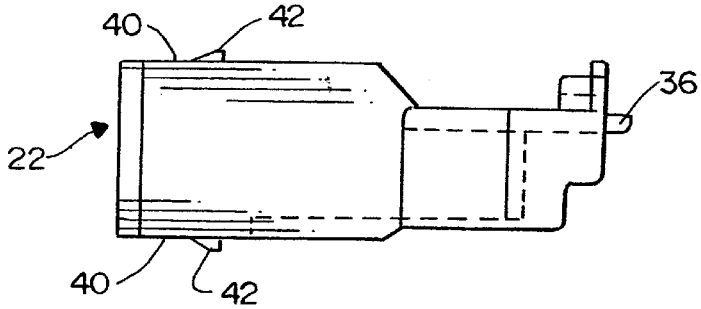
FIG. 5 is a side elevational view of the housing.
Figure 6:
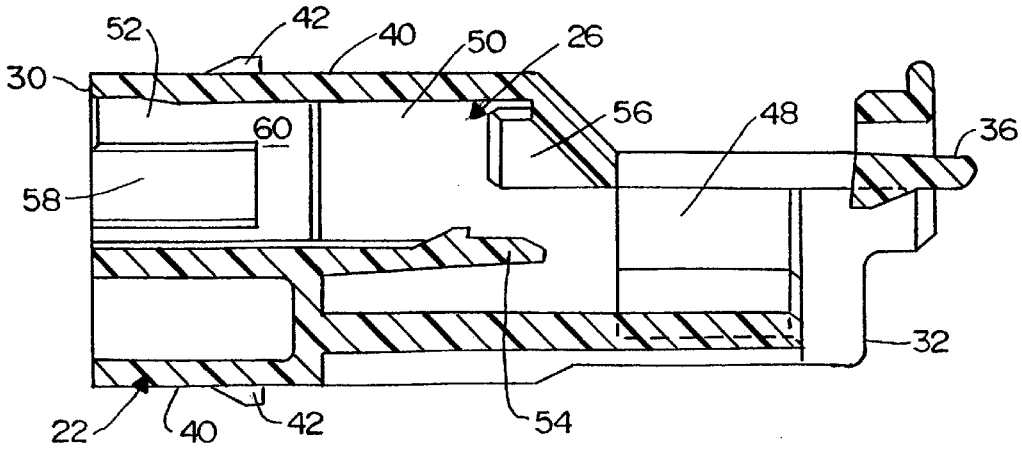
FIG. 6 is an enlarged section taken generally along line 6—6 of FIG. 3.
Figure 7:
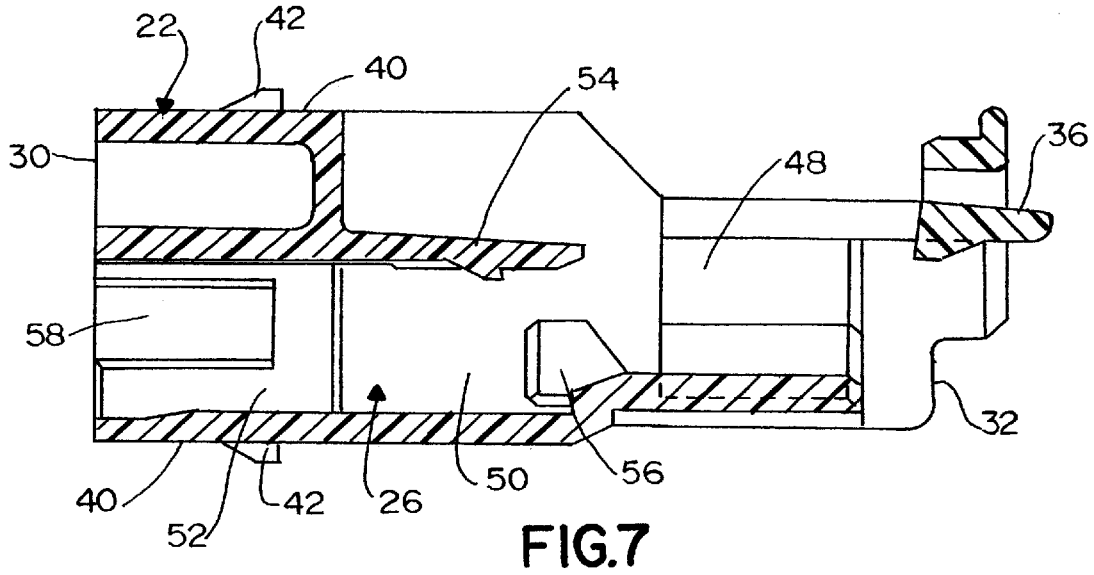
FIG. 7 is an enlarged section taken generally along line 7—7- of FIG. 3.
Figure 8:
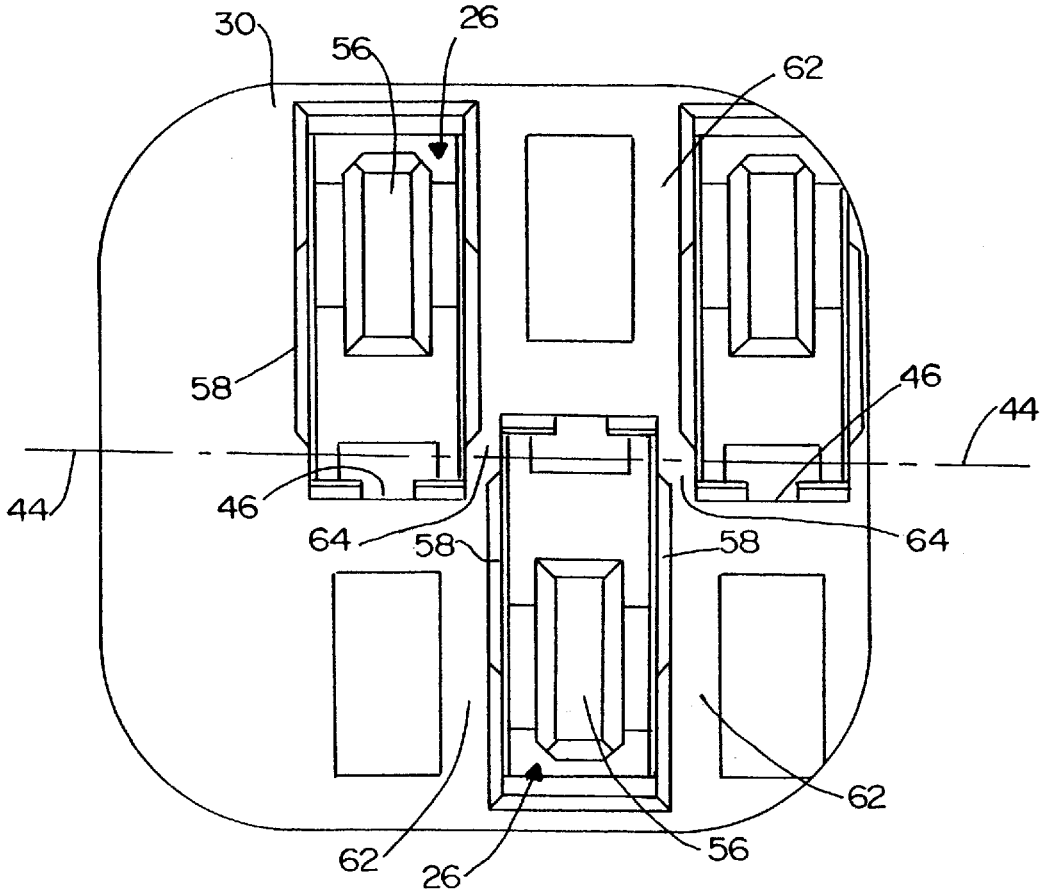
FIG. 8 is a further enlarged, fragmented view of the rear of several passages in the housing.
Figure 9:
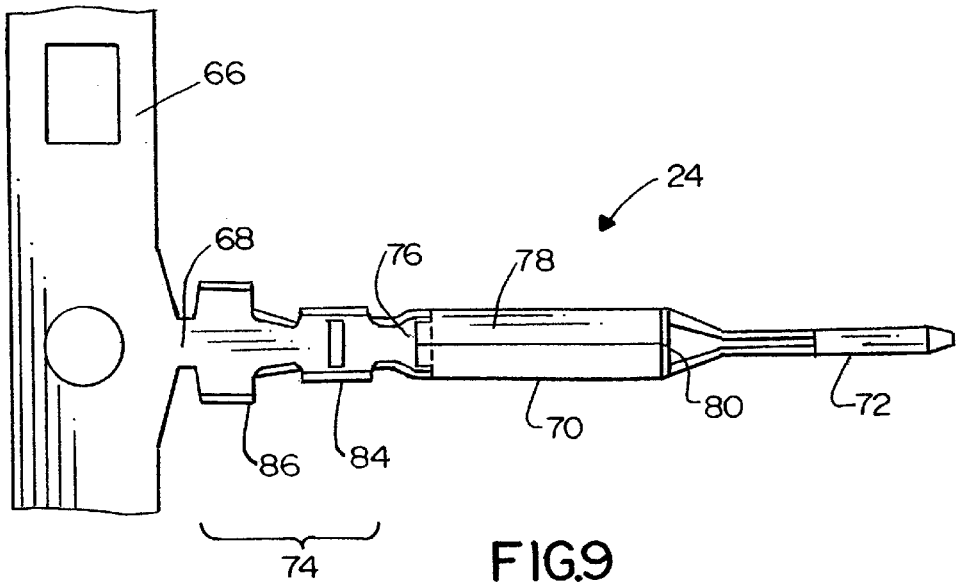
FIG. 9 is a top plan view of one of the terminals (still joined to a carrier web during processing) as the terminal is viewed in FIG. 1A.

As best seen in FIGS. 3 and 8, connector housing 22 is transversely elongated to define a longitudinal axis 44. It can be seen that terminal-receiving passages 26 are arranged in two rows generally on opposite sides of the axis. The passages are alternatingly staggered along axis 44 with adjacent sides 46 of the passages in the two rows thereof overlapping along the axis. In other words, adjacent passages 26 along axis 44 are inverted relative to each other longitudinally of the housing. As best seen in FIGS. 6 and 7, each terminal-receiving passage 26 communicates with a forward cavity 48 which receives complementary mating connector 34 (FIGS. 1A and 1B) as described above. Each cavity includes a central section 50 and a rear section 52. An interior, cantilevered flexible latch arm 54 is disposed at an inner side of central section 50. A rearwardly facing engagement projection 56 is disposed in central section 50 opposite flexible latch arm 54. Expanded recessed areas 58 are provided in side walls 60 of rear sections 52. Finally, as best seen in FIG. 8, sizable partitions or walls 62 separate terminal-receiving passages 26 in each row thereof, and the partitions or walls on opposite sides of axis 44 are joined by integral web portions 64 of the molded plastic housing.

Figure 10:
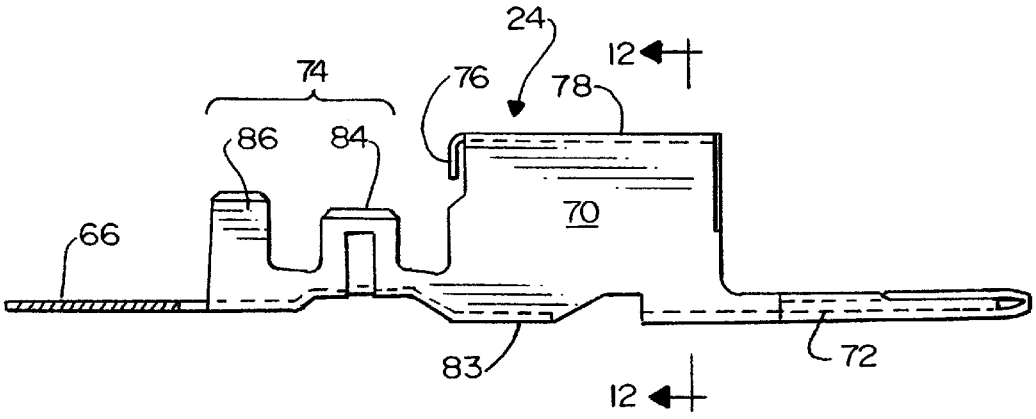
FIG. 10 is a side elevational view of the terminal of FIG. 9.
Figure 11:
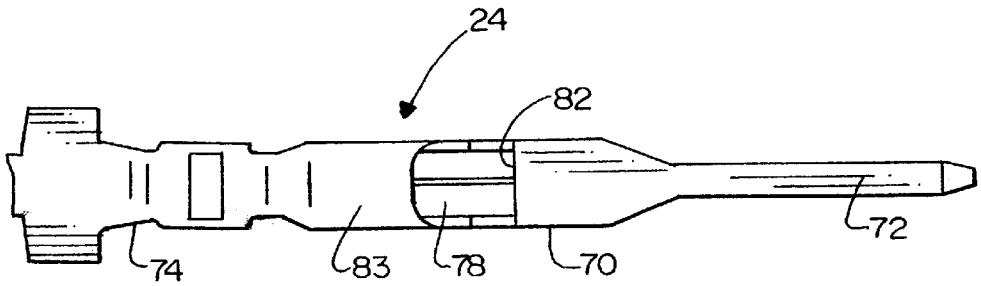
FIG. 11 is a bottom plan view of the terminal.
Figure 12:
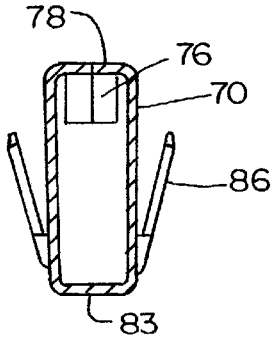
FIG. 12 is a section taken generally along line 12—12 of FIG. 10.

Referring to FIGS. 9–12 in conjunction with FIGS. 1A and 1B, each terminal 24 is stamped and formed of conductive sheet metal material as described above. During processing, the terminals are joined to a carrier strip 66 by a web 68 which is severed after the terminals are stamped and formed. Each terminal includes a center body portion 70, a front contact pin portion 72 and a rear crimping portion 74. As best seen in FIG. 10, body portion 70 is considerably wider than contact pin portion 72. The contact pin portion projects forwardly of the body portion at one side thereof and is generally coplanar therewith. An engagement flap 76 is bent inwardly from an opposite side 78 of body portion 70. A window 80 is formed at the front of the body portion and a latch recess 82 is formed in side 83 of the body portion, all for purposes described hereinafter. Finally, crimping portion 74 of each terminal 24 includes a pair of forward crimp arms 84 and a pair of rearward crimp arms 86. As seen in FIGS. 1A and 1B, forward crimp arms 84 clamp onto a conductor 88 of an electrical wire 90, while rearward crimp arms 86 clamp onto the outer insulation of the electrical wire.

Figure 13:
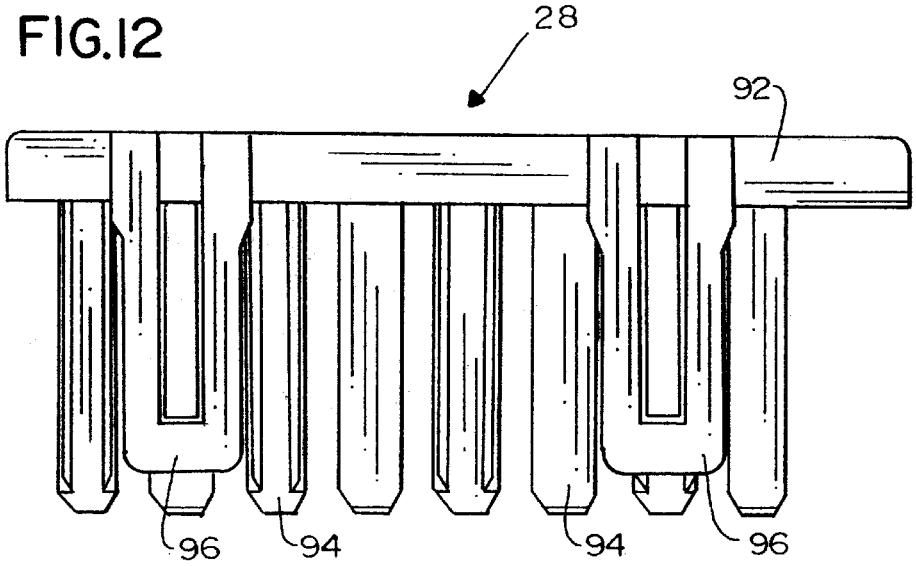
FIG. 13 is a top plan view of the terminal retainer.
Figure 14:
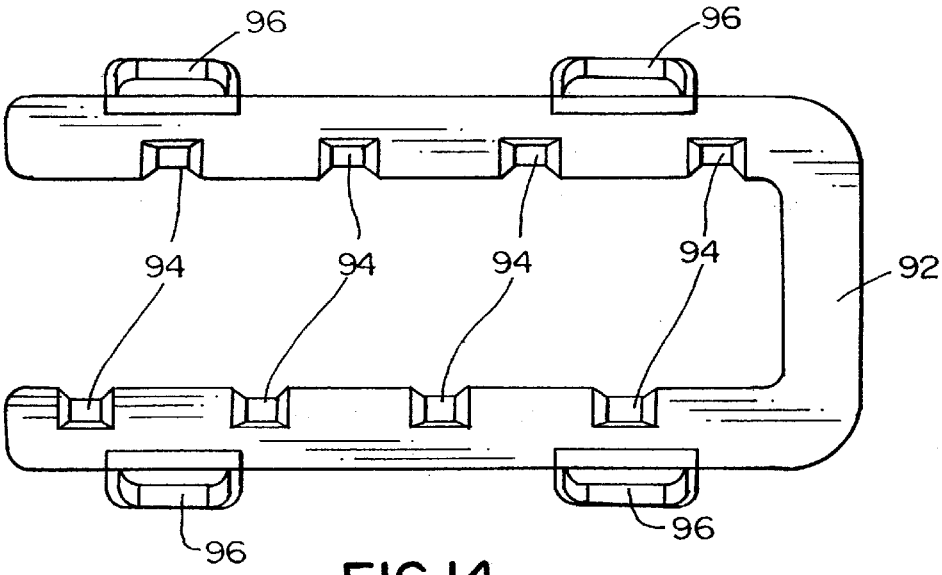
FIG. 14 is a front elevational view of the terminal retainer.
Figure 15:
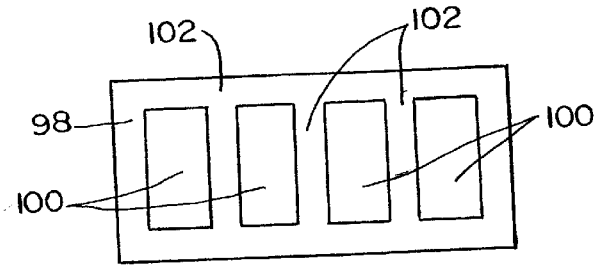
FIG.15 (PRIOR ART)
FIG. 15 is a somewhat schematic illustration of the terminal passages in a connector housing according to the prior art.

Referring to FIGS. 13 and 14 in conjunction with FIGS. 1A and 1B, terminal retainer 28 includes a generally U-shaped body 92 which may be molded of plastic material or the like. The U-shaped body has a plurality of fingers 94 on the inside thereof as best seen in FIG. 14 and projecting therefrom as best seen in FIG. 13. A plurality of latch arms 96 project from the body as best seen in FIG. 13 on the outside of the body as best seen in FIG. 14.

In assembly of electrical connector 20, terminals 24 are inserted into terminal-receiving passages 26 in housing 22 in the direction of arrows "A" (FIGS. 1A and 1B) as stated above. When the terminals are fully inserted, engagement projections 56 within central sections 50 of the passages enter windows 80 at the front of body portions 70 of the terminals. Flexible latch arms 54 within the housing snap into latching engagement within latch recesses 82 in the body portions of the terminals. When the terminals are fully inserted, contact pin portions 72 of the terminals interengage with terminals 38 of complementary mating connector 34. In order to securely hold the terminals within their respective passages in the connector housing, terminal retainer 28 then is mounted to the housing also in the direction of arrows "A". When the terminal retainer is fully mounted on the housing, latch arms 96 on the retainer latchingly engage with latch bosses 42 at the top and bottom of housing 22. The forward distal ends of fingers 94 of the terminal abut against engagement flaps 76 at the rear of body portions 70 of the terminals to securely hold the terminals in their respective passages in the housing.

FIGS. 15–18 show the advantages of the invention. Referring first to the prior art depiction in FIG. 15, it can be seen that a connector housing 98 has a plurality of terminal-receiving passages 100 in a single row and separated by a plurality of partitions or walls 102. The walls are sufficiently wide to provide sufficient strength for the housing and adequate insulation between the passages. Unfortunately, as the number of passages (i.e., terminals) in the connector increases, housing 98 becomes excessively long if partitions 102 are maintained sufficiently thick.

Figure 16:
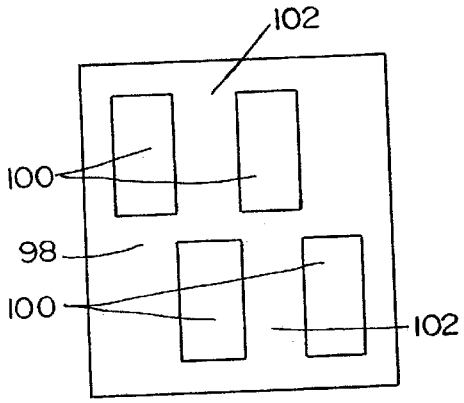
FIG.16 (PRIOR ART)
FIG. 16 is a view similar to that of FIG. 15, but showing an alternate configuration of the prior art.

In order to avoid excessively lengthening the connector housing, it has been proposed to provide passages 100 in housing 98 in two rows according to the prior art depiction in FIG. 16. It can be seen that adequate walls 102 are provided between the passages to provide for strength of the housing and adequate insulation between the passages. However, housing 98 in FIG. 16 may be excessively wide for many applications.

Figure 17:
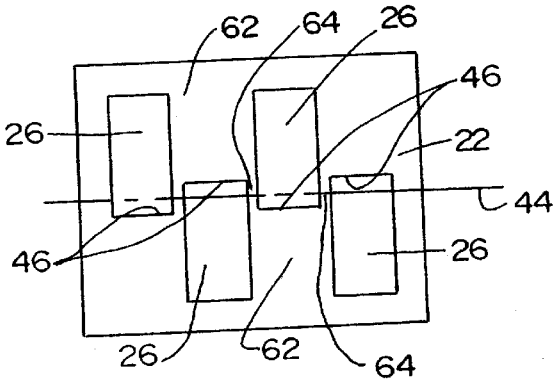
FIGS. 17 and 18 show passage configurations or arrangements according to the invention.
Figure 18:
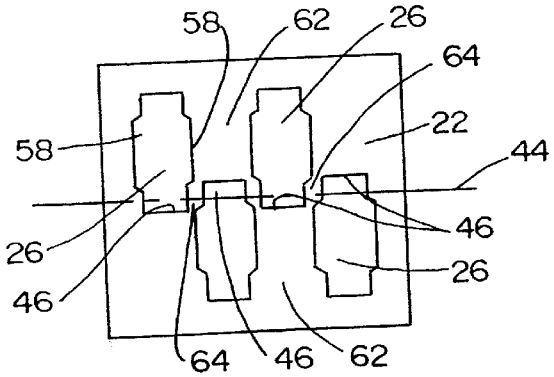

FIGS. 17 and 18 show how the invention solves the problems of the prior art explained above in relation to FIGS. 15 and 16. It can be seen that while terminal-receiving passages 26 in housing 22 are arranged generally in two rows on opposite sides of axis 44, the passages are alternatingly staggered along the axis, with adjacent sides 46 of the passages in the two rows overlapping along axis 44. This leaves significantly sized walls or partitions 62 between the passages in each row, joined by integral webs 64. The result is that housings 22 in FIGS. 17 and 18 are both shorter than the prior art housing 102 in FIG. 15 and narrower than the housing 102 in the prior art of FIG. 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

an insulating housing defining a longitudinal axis with two rows of terminal-receiving passages generally on opposite sides of said axis, the passages being alternatingly staggered along the axis with adjacent sides of the passages in the two rows thereof overlapping along the axis;

a plurality of conductive terminals received in said passages, each terminal including a relatively wide body portion with a relatively narrow contact portion projecting from one side of the body portion, the terminals being disposed in the passages in alternating orientations longitudinally of said axis whereby said contact portions of the terminals are disposed in the overlapping sides of the passages to define a single row of contact portions longitudinally of the axis; and a terminal retainer including a plurality of fingers extending into said passages and into retaining engagement with a side of the body portion of the terminals, opposite the contact portion, to hold the terminals in their respective passages in the housing.

2. The electrical connector of claim 1 wherein said terminals are stamped and formed of conductive sheet metal material.

3. The electrical connector of claim 1 wherein said contact portion projects from one end of the body portion of each terminal, and including a terminating portion at an opposite end of the body portion.

4. The electrical connector of claim 3 wherein said terminating portion comprises a crimping section of the terminal for clamping onto an electrical wire.

5. The electrical connector of claim 1 wherein said terminal retainer is mountable on the outside of the housing.

6. The electrical connector of claim 5, including complementary interengaging latch means between the terminal retainer and the housing.

7. The electrical connector of claim 1 wherein said contact portion of each terminal comprises a pin projecting from the one side of the body portion.

8. An electrical connector, comprising:

an insulating housing defining a longitudinal axis with two rows of terminal-receiving passages generally on opposite sides of said axis, the passages being alternatingly staggered along the axis with adjacent sides of the passages in the two rows thereof overlapping along the axis; and a plurality of stamped and formed conductive sheet metal terminals received in said passages, each terminal including a relatively wide body portion with a relatively narrow contact pin portion projecting from one side and one end of the body portion, a terminating crimp portion at an opposite end of the body portion for clamping onto an electrical wire, and the terminals being disposed in the passages in alternating orientations longitudinally of said axis whereby said contact pin portions of the terminals are disposed in the overlapping sides of the passages to define a single row of contact pin portions longitudinally of the axis; and a terminal retainer including a plurality of fingers extending into said passages and into retaining engagement with the side of the body portion of the terminals, opposite the contact portion, to hold the terminals in their respective passages in the housing.

9. The electrical connector of claim 8 wherein said terminal retainer is mountable on the outside of the housing.

10. The electrical connector of claim 9, including complementary interengaging latch means between the terminal retainer and the housing.

* * * * *